US009608319B2

(12) United States Patent
Tanaka et al.

(10) Patent No.: US 9,608,319 B2
(45) Date of Patent: Mar. 28, 2017

(54) FLEXIBLE SUBSTRATE ANTENNA AND ANTENNA DEVICE

(75) Inventors: Hiroya Tanaka, Kyoto-fu (JP); Yuichi Kushihi, Kyoto-fu (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 621 days.

(21) Appl. No.: 13/402,791

(22) Filed: Feb. 22, 2012

(65) Prior Publication Data

US 2012/0146856 A1 Jun. 14, 2012

Related U.S. Application Data

(63) Continuation of application No. PCT/JP2010/057208, filed on Apr. 23, 2010.

(30) Foreign Application Priority Data

Aug. 27, 2009 (JP) ..... 2009-196504
Aug. 27, 2009 (JP) ..... 2009-196521

(51) Int. Cl.
*H01Q 1/38* (2006.01)
*H01Q 9/04* (2006.01)
*H01Q 19/00* (2006.01)

(52) U.S. Cl.
CPC ..... *H01Q 1/38* (2013.01); *H01Q 9/0421* (2013.01); *H01Q 19/005* (2013.01)

(58) Field of Classification Search
USPC ..... 343/700 MS, 702
See application file for complete search history.

(56) References Cited

U.S. PATENT DOCUMENTS 5,861,854 A 1/1999 Kawahata
5,903,240 A 5/1999 Kawahata et al.
5,959,582 A 9/1999 Kawahata et al.
6,300,909 B1 10/2001 Tsubaki et al.
6,614,398 B2 * 9/2003 Kushihi ..... H01Q 1/243 343/700 MS (Continued)

FOREIGN PATENT DOCUMENTS

CN 1171640 A 1/1998
EP 0790663 A1 8/1997

(Continued)

OTHER PUBLICATIONS

International Search Report; PCT/JP2010/057208; Jul. 27, 2010.

(Continued)

*Primary Examiner* — Hoang V Nguyen
*Assistant Examiner* — Hai Tran
(74) *Attorney, Agent, or Firm* — Studebaker & Brackett PC

(57) ABSTRACT

This disclosure provides a flexible substrate antenna and antenna device including a flexible substrate antenna. The flexible substrate antenna includes a first parasitic radiation electrode and a second parasitic radiation electrode provided on the flexible substrate, where a leading ends (open ends) of the first parasitic radiation electrode and the second parasitic radiation electrode face each other with a slit of a predetermined gap therebetween. Further, a capacitive feed electrode is formed on the flexible substrate at a position facing the first parasitic radiation electrode, and is configured to capacitively feed power to the first parasitic radiation electrode.

7 Claims, 7 Drawing Sheets

(56) References Cited

U.S. PATENT DOCUMENTS

| | | | | |
|---|---|---|---|---|
| 6,803,881 | B2 * | 10/2004 | Ishihara | H01Q 1/38 343/700 MS |
| 6,891,506 | B2 * | 5/2005 | Jarmuszewski | H01Q 1/243 343/702 |
| 2002/0030626 | A1 | 3/2002 | Nagumo et al. | |
| 2002/0140610 | A1 | 10/2002 | Onaka et al. | |
| 2002/0163470 | A1 | 11/2002 | Nagumo et al. | |
| 2003/0006936 | A1 | 1/2003 | Aoyama et al. | |
| 2003/0071757 | A1 | 4/2003 | Yamaki | |
| 2004/0032369 | A1 * | 2/2004 | Flowers | H01Q 19/005 343/701 |
| 2004/0108957 | A1 | 6/2004 | Umehara et al. | |
| 2006/0290572 | A1 * | 12/2006 | Chan | H01Q 1/243 343/700 MS |
| 2008/0136712 | A1 | 6/2008 | Suzuki | |
| 2008/0180342 | A1 * | 7/2008 | Kerselaers | H01Q 9/285 343/795 |
| 2009/0040120 | A1 | 2/2009 | Tsubaki et al. | |

FOREIGN PATENT DOCUMENTS

| | | | |
|---|---|---|---|
| EP | 0814535 | A2 | 12/1997 |
| EP | 0848448 | A2 | 6/1998 |
| EP | 1109251 | A2 | 6/2001 |
| EP | 1146590 | A2 | 10/2001 |
| EP | 1248316 | A2 | 10/2002 |
| EP | 1267441 | A2 | 12/2002 |
| EP | 1933414 | A2 | 6/2008 |
| EP | 2065975 | A1 | 6/2009 |
| JP | 07-131234 | A | 5/1995 |
| JP | 10-013139 | A | 1/1998 |
| JP | H10-173425 | A | 6/1998 |
| JP | H10-173426 | A | 6/1998 |
| JP | H11-27026 | A | 1/1999 |
| JP | 11-127014 | A | 5/1999 |
| JP | 2000-068726 | A | 3/2000 |
| JP | 3307248 | B2 | 7/2002 |
| JP | 2003-110346 | A | 4/2003 |
| JP | 2003-133844 | A | 5/2003 |
| JP | 2003-313844 | A | 5/2003 |
| JP | 3656470 | B2 | 6/2005 |
| JP | 3661432 | B2 | 6/2005 |
| JP | 2007-235215 | A | 9/2007 |

OTHER PUBLICATIONS

Written Opinion of the International Searching Authority; PCT/JP2010/057208; Jul. 27, 2010.

The First Office Action issed by the State Intellectual Property Office of People's Republic of China on Sep. 13, 2013, which corresponds to Chinese Patent Application No. 201080037726.2 and is related to U.S. Appl. No. 13/402,791; with translation.

The second Office Action issued by the State Intellectual Property Office of People's Republic of China on Feb. 24, 2014, which corresponds to Chinese Patent Application No. 201080037726.2 and is related to U.S. Appl. No. 13/402,791; with translation.

The Examination Report under Section 18(3) issued by the United Kingdom Intellectual Property Office on Jan. 30, 2014, which corresponds to U.K. Patent Application No. GB1203342.9 and is related to U.S. Appl. No. 13/402,791.

The Examination Report under Section 18(3) issued by the United Kingdom Intellectual Property Office on Sep. 4, 2014, which corresponds to United Kingdom Patent Application No. GB1203342.9 and is related to U.S. Appl. No. 13/402,791.

The Examination Report under Section 18(3) issued by the United Kingdom Intellectual Property Office on Dec. 19, 2014, which corresponds to United Kingdom Patent Application No. GB1203342.9 and is related to U.S. Appl. No. 13/402,791, 2014.

* cited by examiner

FLEXIBLE SUBSTRATE ANTENNA AND ANTENNA DEVICE

CROSS REFERENCE TO RELATED APPLICATIONS

The present application is a continuation of International Application No. PCT/JP2010/057208 filed on Apr. 23, 2010, which claims priority to Japanese Patent Application No. 2009-196521 filed on Aug. 27, 2009, and to Japanese Patent Application No. 2009-196504 filed on Aug. 27, 2009, the entire contents of each of these applications being incorporated herein by reference in their entirety.

TECHNICAL FIELD

This invention relates to a flexible substrate-type antenna and an antenna device including the flexible substrate-type antenna, and, in particular, relates to a flexible substrate antenna, whose radiation electrode is formed in a flexible substrate, and an antenna device.

BACKGROUND

In Japanese Unexamined Patent Application Publication No. 7-131234 (PTL 1), an antenna is illustrated in which two plate-like radiation conductor plates facing each other with a predetermined distance therebetween are formed in a flexible substrate. FIG. 1 is the perspective view of the antenna illustrated in PTL 1.

As illustrated in FIG. 1, along with another plate-like radiation conductor plate 2, a plate-like radiation conductor plate 1 is disposed above one ground conductor plate 3 so as to face the ground conductor plate 3. The two plate-like radiation conductor plates 1 and 2 are formed on a same flexible substrate 4, and a solid dielectric 5 is disposed in place of a spacer between the plate-like radiation conductor plates 1 and 2 and a ground conductor plate 3 so that the two plate-like radiation conductor plates 1 and 2 face the ground conductor plate 3. In addition, power is fed from a feeding point 6 to the plate-like radiation conductor plate 1.

Both of the two plate-like radiation conductor plates 1 and 2 are connected to the ground conductor plate 3 using short circuit conductor plates 7 and 8. In addition, the width and the length including a distance between the plate-like radiation conductor plates 1 and 2 are adjusted so that an adequate double resonance is caused to occur owing to two antennae and a wideband characteristic.

In addition, in Japanese Unexamined Patent Application Publication No. 2003-110346 (PTL 2), a dielectric antenna is disclosed where a feeding electrode is provided on the back surface of a dielectric substrate to capacitively feed power to a radiation electrode on a front surface (top surface). Two radiation electrodes are provided, where one end of each of the two electrodes is connected to a ground.

In addition, in Japanese Unexamined Patent Application Publication No. 11-127014 (PTL 3), a dielectric antenna is disclosed that includes a capacitive feed-type radiation element and two radiation electrodes, one end of each of which is connected to a ground.

SUMMARY

The present disclosure provides a flexible substrate antenna and an antenna device including the flexible substrate antenna which can suppress capacitance occurring between the flexible substrate antenna and an adjacent ground electrode without the antenna totally growing in size.

In one aspect of the disclosure, a flexible substrate antenna according includes a flexible substrate, a first parasitic radiation electrode and a second parasitic radiation electrode on the flexible substrate and facing each other with a slit-like gap therebetween. A capacitive feed electrode is on the flexible substrate, faces the first parasitic radiation electrode, and is configured to capacitively feed power to the first parasitic radiation electrode.

In a more specific embodiment, any one of the capacitive feed electrode, the first parasitic radiation electrode, and the second parasitic radiation electrode may be formed in a first surface of the flexible substrate.

In another more specific embodiment, the flexible substrate antenna further includes a frequency adjustment electrode configured to be formed on the flexible substrate, facing the first parasitic radiation electrode and the second parasitic radiation electrode, and configured to be grounded In yet another more specific embodiment, in the frequency adjustment electrode, ground terminals electrically connected to a ground electrode are provided at two points corresponding to an end portion on a side facing the first parasitic radiation electrode and an end portion on a side facing the second parasitic radiation electrode. According to this structure, since the frequency adjustment electrode becomes a current path, it is possible to reduce the resonance frequency of the antenna owing to the influence of the inductance component of the frequency adjustment electrode. Accordingly, it is possible to downsize the antenna.

In another more specific embodiment, the frequency adjustment electrode, the first parasitic radiation electrode, and the second parasitic radiation electrode may be formed on a first surface of the flexible substrate.

In another more specific embodiment, in the same way as the frequency adjustment electrode, the first parasitic radiation electrode, and the second parasitic radiation electrode, the capacitive feed electrode may also be formed in the first surface of the flexible substrate.

In still another more specific embodiment, the capacitive feed electrode, the first parasitic radiation electrode, and the second parasitic radiation electrode may be formed in the first surface of the flexible substrate, and the frequency adjustment electrode may be formed in a second surface of the flexible substrate.

In another aspect of the disclosure, an antenna device includes any one of the above-mentioned flexible substrate antennae, and a chassis to which the flexible substrate antenna is attached.

In yet another aspect of the disclosure, the antenna device includes any one of the above-mentioned flexible substrate antennae, and a carrier to which the flexible substrate antenna is attached and that is mounted on a circuit substrate.

DETAILED DESCRIPTION

The inventors realized that because the structures of the antennae illustrated in PTL 1, PTL 2, and PTL 3 are designed so as to mainly obtain double resonance or wider bandwidths, and have passive electrodes, the antenna structures usually tend to grow in size. In addition, with the ground electrode of a circuit substrate adjacent an antenna element or with an antenna element mounted on the ground electrode of the circuit substrate, a problem of antenna gain deterioration arises from the influence of the relative permittivity of a dielectric material or a flexible substrate, and capacitance occurring between a radiation electrode and ground.

Figure 1:
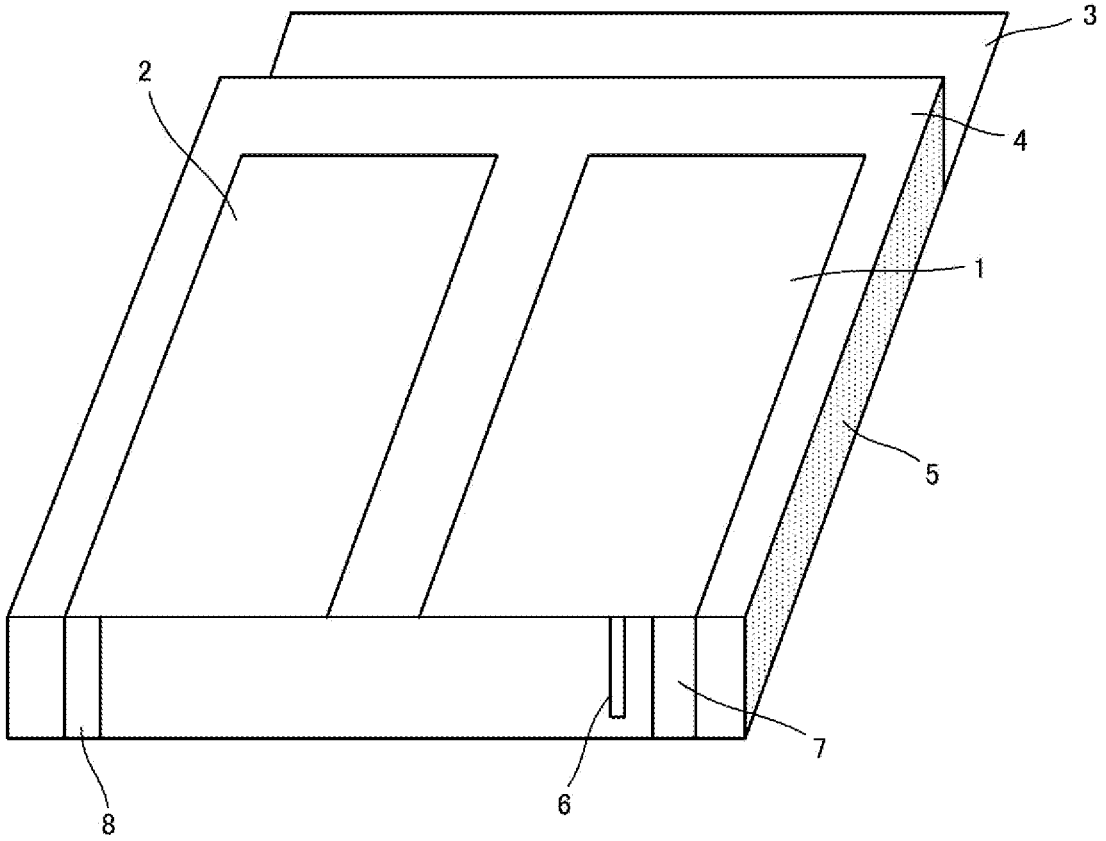
FIG.1 Prior Art
FIG. 1 is a perspective view of an antenna illustrated in PTL 1.
Figure 2:
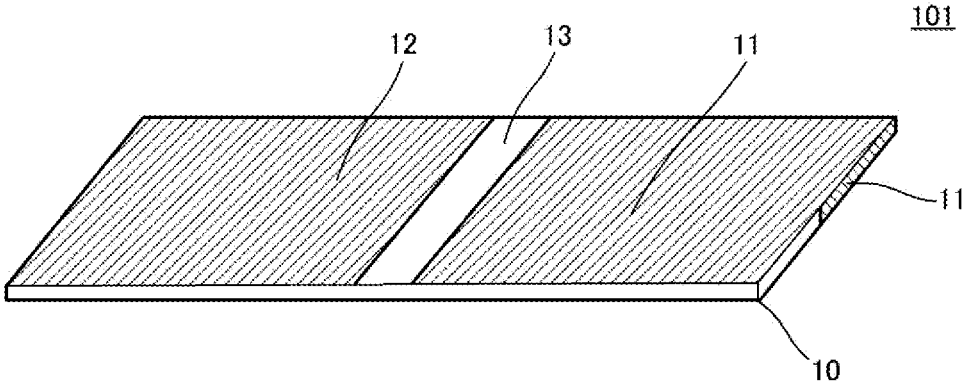
FIG. 2 is a perspective view of a flexible substrate antenna 101 according to a first exemplary embodiment.
Figure 3:
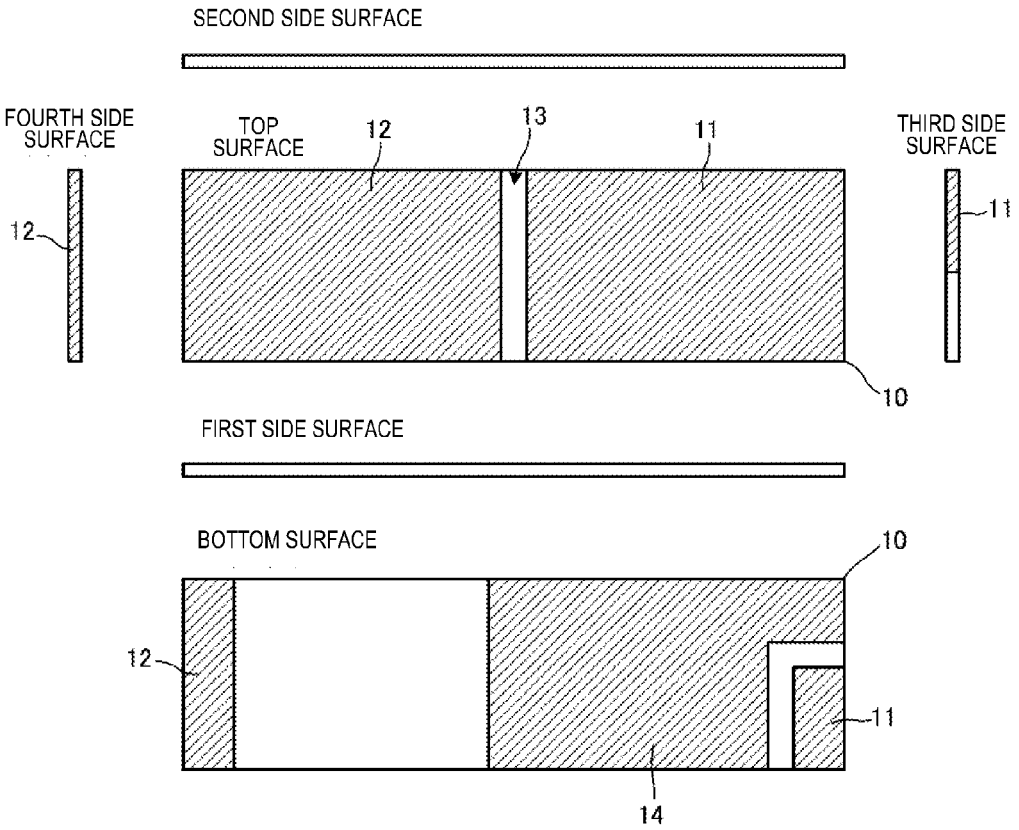
FIG. 3 is a six-surface view of the flexible substrate antenna 101 according to the first exemplary embodiment.
Figure 4:
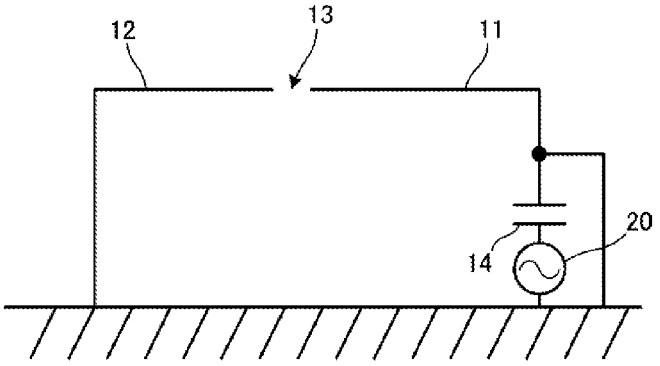
FIG. 4 is an equivalent circuit diagram of the flexible substrate antenna 101 according to the first exemplary embodiment.

FIG. 2 is a perspective view of a flexible substrate antenna 101 according to a first exemplary embodiment, FIG. 3 is the six-surface view of the flexible substrate antenna 101, and FIG. 4 is the equivalent circuit diagram of the flexible substrate antenna 101.

A rectangle plate-like flexible substrate 10 includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 11 is formed so as to extend from the bottom surface of the flexible substrate 10 to the top surface (first surface) through the third side surface. In addition, a second parasitic radiation electrode 12 is formed so as to extend from the bottom surface of the flexible substrate 10 to the top surface through the fourth side surface. The leading ends (open ends) of the first parasitic radiation electrode 11 and the second parasitic radiation electrode 12 face each other on the top surface of the flexible substrate 10 with a slit 13 of a predetermined gap therebetween.

On the bottom surface of the flexible substrate 10, a capacitive feed electrode 14 is formed at a position facing the first parasitic radiation electrode 11.

The first parasitic radiation electrode 11 and the second parasitic radiation electrode 12, formed on the bottom surface of the flexible substrate 10, are used as ground terminals for connecting to a ground electrode of a mounting destination.

As illustrated in FIG. 4, in the above-mentioned flexible substrate antenna 101, both end portions of the first parasitic radiation electrode 11 and the second parasitic radiation electrode 12 are connected to a ground. In addition, since capacitance exists between the first parasitic radiation electrode 11 and a power feeding circuit 20, power is capacitively fed to the first parasitic radiation electrode 11.

According to this structure, the following function effect is obtained: Both of the open ends of the first parasitic radiation electrode 11 and the second parasitic radiation electrode 12 are caused to be adjacent to each other. Therefore, capacitance occurs between the first parasitic radiation electrode 11 and the second parasitic radiation electrode 12, and it is possible to reduce the resonance frequency of the antenna. Accordingly, it is possible to downsize the antenna.

Figure 5:
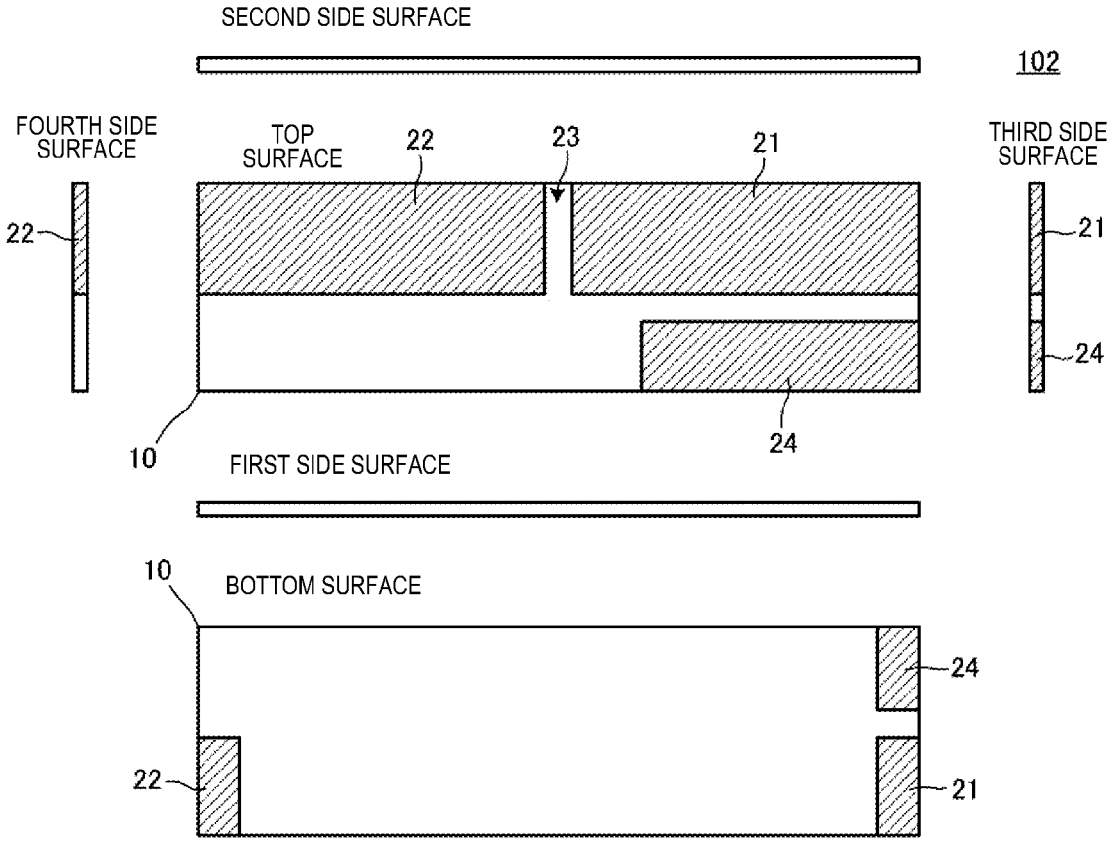
FIG. 5 is a six-surface view of a flexible substrate antenna 102 according to a second exemplary embodiment.

FIG. 5 is the six-surface view of a flexible substrate antenna 102 according to a second exemplary embodiment.

A rectangle plate-like flexible substrate 10 according to the second exemplary embodiment includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 21 is formed so as to extend from the bottom surface of the flexible substrate 10 to the top surface through the third side surface. In addition, a second parasitic radiation electrode 22 is formed so as to extend from the bottom surface of the flexible substrate 10 to the top surface through the fourth side surface. The leading ends (open ends) of the first parasitic radiation electrode 21 and the second parasitic radiation electrode 22 face each other on the top surface of the flexible substrate 10 with a slit 23 of a predetermined gap therebetween.

On the top surface of the flexible substrate 10, a capacitive feed electrode 24 is formed at a position facing the first parasitic radiation electrode 21 within a plain surface.

The first parasitic radiation electrode 21 and the second parasitic radiation electrode 22, formed on the bottom surface of the flexible substrate 10, are used as ground terminals for connecting to a ground electrode of a mounting destination.

The equivalent circuit diagram of this flexible substrate antenna 102 is the same as that illustrated in FIG. 4. A function effect is also as described in the first embodiment.

In addition, according to the structure illustrated in FIG. 5, since the capacitive feed electrode 24, the first parasitic radiation electrode 21, and the second parasitic radiation electrode 22 are substantially simultaneously patterned, high dimension accuracy is obtained, and it is also possible to suppress a variation in capacitance occurring between the first parasitic radiation electrode 21 and the capacitive feed electrode 24.

Figure 6:
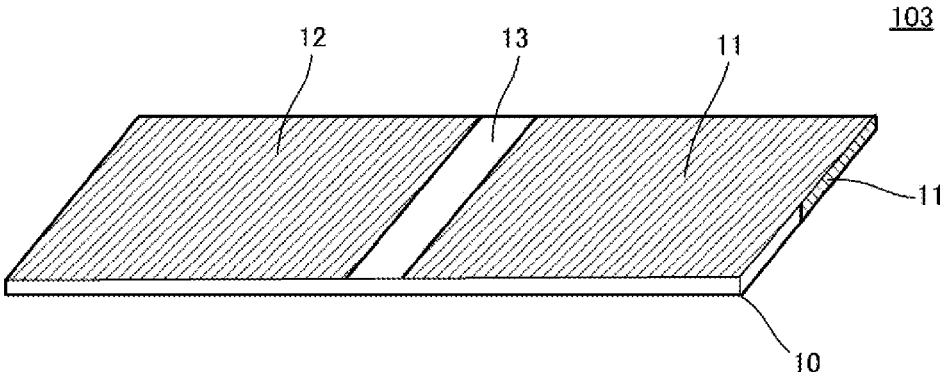
FIG. 6 is a perspective view of a flexible substrate antenna 103 according to a third exemplary embodiment.
Figure 7:
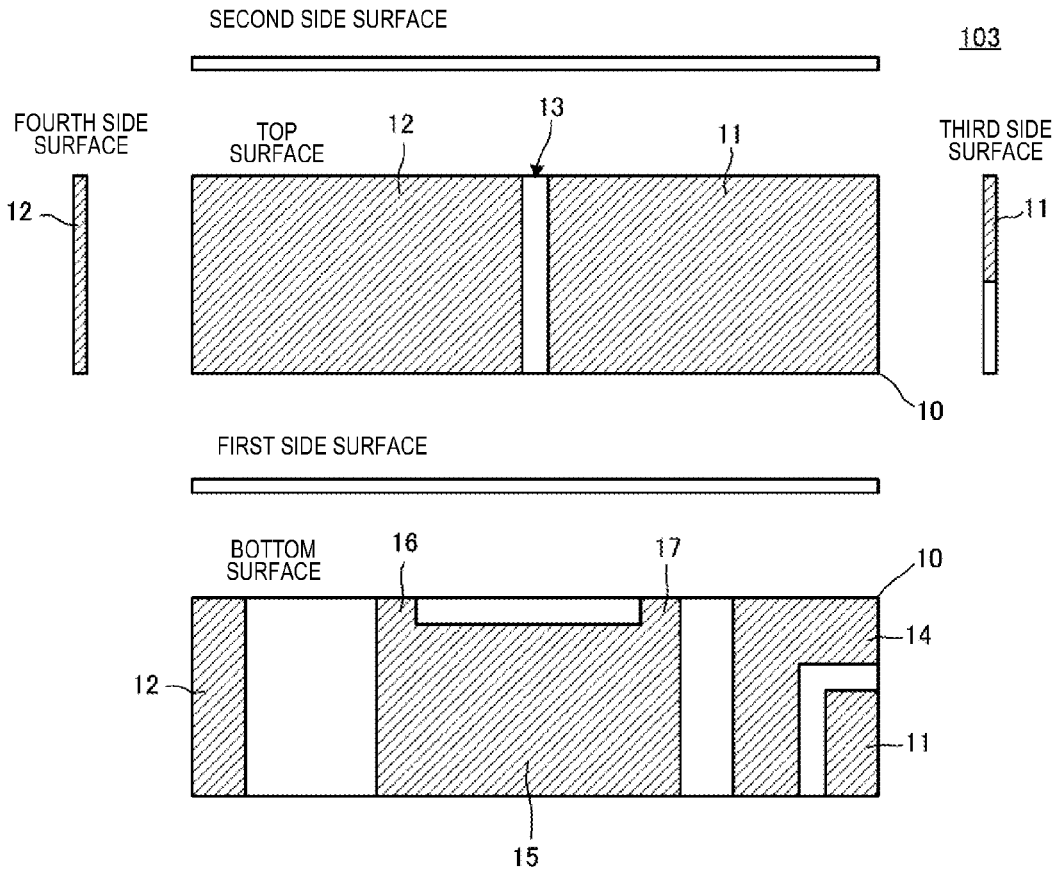
FIG. 7 is a six-surface view of the flexible substrate antenna 103 according to the third exemplary embodiment.
Figure 8:
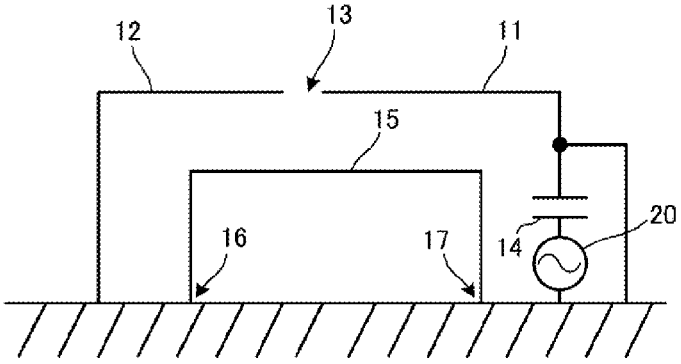
FIG. 8 is an equivalent circuit diagram of the flexible substrate antenna 103 according to the third exemplary embodiment.

FIG. 6 is the perspective view of a flexible substrate antenna 103 according to a third exemplary embodiment, FIG. 7 is the six-surface view of the flexible substrate antenna 103, and FIG. 8 is the equivalent circuit diagram of the flexible substrate antenna 103.

A rectangle plate-like flexible substrate 10 according to the third exemplary embodiment includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 11 is formed so as to extend from the bottom surface of the flexible substrate 10 to the top surface (first surface) through the third side surface. In addition, a second parasitic radiation electrode 12 is formed so as to extend from the bottom surface of the flexible substrate 10 to the top surface through the fourth side surface. The leading ends (open ends) of the first parasitic radiation electrode 11 and the second parasitic radiation electrode 12 face each other on the top surface of the flexible substrate 10 with a slit 13 of a predetermined gap therebetween.

On the bottom surface (second surface) of the flexible substrate 10, a frequency adjustment electrode 15 is formed. This frequency adjustment electrode 15 faces the first parasitic radiation electrode 11 and the second parasitic radiation electrode 12 with sandwiching the base material of the flexible substrate 10 therebetween. Therefore, predetermined capacitances occur between the first parasitic radiation electrode 11 and the frequency adjustment electrode 15 and between the second parasitic radiation electrode 12 and the frequency adjustment electrode 15, respectively.

Ground terminals 16 and 17 are extracted from both end portions of the frequency adjustment electrode 15, the ground terminals 16 and 17 are to be conductively connected to a ground electrode of a mounting destination.

Furthermore, on the bottom surface of the flexible substrate 10, a capacitive feed electrode 14 is formed at a position facing the first parasitic radiation electrode 11.

The first parasitic radiation electrode 11 and the second parasitic radiation electrode 12, formed on the bottom surface of the flexible substrate 10, are used as ground terminals for connecting to a ground electrode of a mounting destination.

As illustrated in FIG. 8, in the above-mentioned flexible substrate antenna 103, both end portions of the first parasitic radiation electrode 11 and the second parasitic radiation electrode 12 are connected to a ground. In addition, since capacitance exists between the first parasitic radiation electrode 11 and a power feeding circuit 20, power is capacitively fed to the first parasitic radiation electrode 11.

In addition, as illustrated in FIG. 8, the frequency adjustment electrode 15 connected to the ground electrode follows the first parasitic radiation electrode 11 and the second parasitic radiation electrode 12 so as to be adjacent thereto. Accordingly, capacitances between the first parasitic radiation electrode 11 and the frequency adjustment electrode 15 and between the second parasitic radiation electrode 12 and the frequency adjustment electrode 15 are set respectively.

According to this structure, the following function effect is obtained: Both of the open ends of the first parasitic radiation electrode 11 and the second parasitic radiation electrode 12 are caused to be adjacent to each other. Therefore, capacitance occurs between the first parasitic radiation electrode 11 and the second parasitic radiation electrode 12, and it is possible to reduce the resonance frequency of the antenna. In addition, since capacitances individually occur between the grounded frequency adjustment electrode 15 and the first parasitic radiation electrode 11 and between the grounded frequency adjustment electrode 15 and the second parasitic radiation electrode 12, it is possible to reduce the resonance frequency of the antenna. Accordingly, it is possible to downsize the antenna.

The capacitances occur between the first parasitic radiation electrode 11 and the frequency adjustment electrode 15 and between the second parasitic radiation electrode 12 and the frequency adjustment electrode 15, respectively, currents flowing in the parasitic radiation electrode 11 and the parasitic radiation electrode 12 flow into the frequency adjustment electrode 15 through the ground, and the frequency adjustment electrode 15 becomes a current path. Therefore, since the inductance component of the frequency adjustment electrode 15 is added, it is possible to reduce the resonance frequency of the antenna. Accordingly, it is possible to downsize the antenna.

In addition, while, depending on the environment of the mounting destination, capacitance that occurs between the first and second parasitic radiation electrodes 11 and 12 and the ground electrode of the mounting destination varies, it is possible to set the resonance frequency of the antenna without changing the capacitance occurring between the first and second parasitic radiation electrodes 11 and 12 and the ground electrode of the mounting destination.

Since the surfaces of the first parasitic radiation electrode 11 and the second parasitic radiation electrode 12 face the frequency adjustment electrode 15 through the base material of the flexible substrate, it is possible to cause predetermined capacitances to occur between the first parasitic radiation electrode 11 and the frequency adjustment electrode 15 and between the second parasitic radiation electrode 12 and the frequency adjustment electrode 15, using the frequency adjustment electrode 15 whose area is relatively small.

Figure 9:
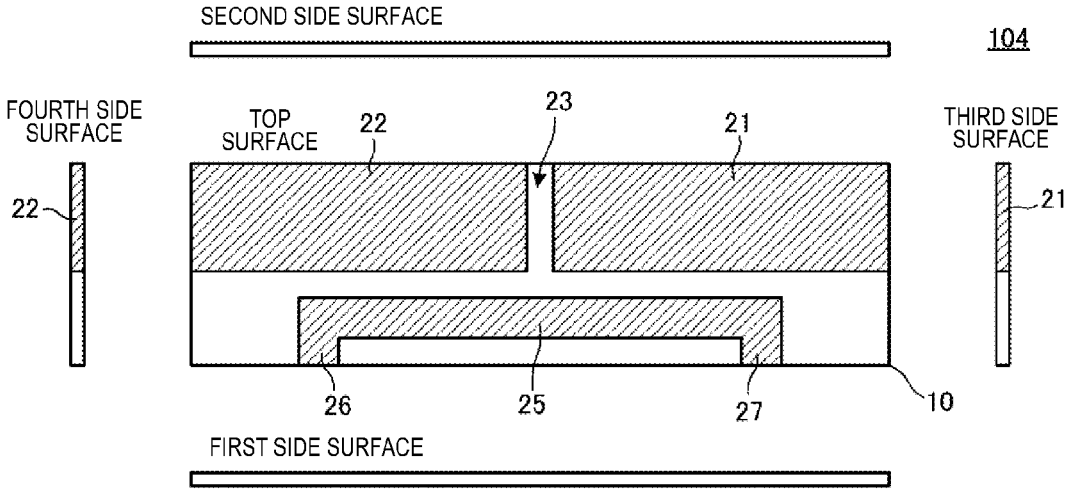
FIG. 9 is a six-surface view of a flexible substrate antenna 104 according to a fourth exemplary embodiment.
Figure 9:
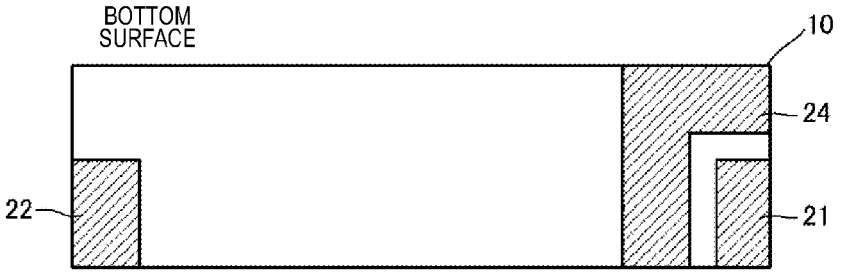

FIG. 9 is the six-surface view of a flexible substrate antenna 104 according to a fourth exemplary embodiment.

A rectangle plate-like flexible substrate 10 according to the fourth exemplary embodiment includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 21 is formed so as to extend from the bottom surface of the flexible substrate 10 to the top surface through the third side surface. In addition, a second parasitic radiation electrode 22 is formed so as to extend from the bottom surface of the flexible substrate 10 to the top surface through the fourth side surface. The leading ends (open ends) of the first parasitic radiation electrode 21 and the second parasitic radiation electrode 22 face each other on the top surface of the flexible substrate 10 with a slit 23 of a predetermined gap therebetween.

On the top surface of the flexible substrate 10, a frequency adjustment electrode 25 is formed. This frequency adjustment electrode 25 faces the first parasitic radiation electrode 21 and the second parasitic radiation electrode 22 within a plain surface. Therefore, a predetermined capacitance occurs between the first and second parasitic radiation electrodes 21, 22 and the frequency adjustment electrode 25.

Ground terminals 26 and 27 are extracted from both end portions of the frequency adjustment electrode 25, the ground terminals 26 and 27 are to be conductively connected to a ground electrode of a mounting destination.

Furthermore, on the bottom surface of the flexible substrate 10, a capacitive feed electrode 24 is formed at a position facing the first parasitic radiation electrode 21.

The first parasitic radiation electrode 21 and the second parasitic radiation electrode 22, formed on the bottom surface of the flexible substrate 10, are used as ground terminals for connecting to a ground electrode of a mounting destination.

The equivalent circuit diagram of this flexible substrate antenna 104 is the same as that illustrated in FIG. 8. A function effect is also as described in the third exemplary embodiment.

In addition, according to the structure illustrated in FIG. 9, since the frequency adjustment electrode 25, the first parasitic radiation electrode 21, and the second parasitic radiation electrode 22 are substantially simultaneously patterned, high dimension accuracy is obtained, and it is possible to easily enhance the accuracy of the capacitance occurring between the first and second parasitic radiation electrodes 21, 22 and the frequency adjustment electrode 25.

Figure 10:
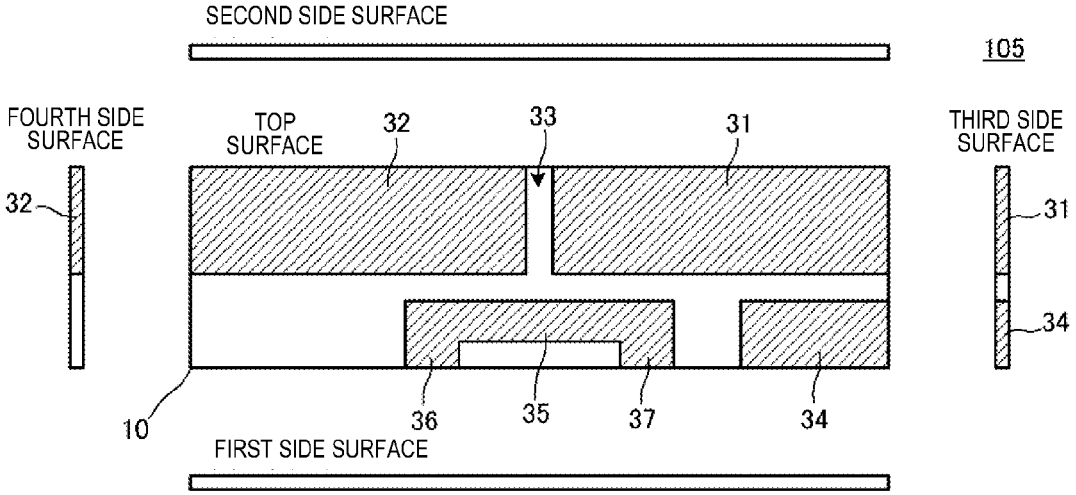
FIG. 10 is a six-surface view of a flexible substrate antenna 105 according to a fifth exemplary embodiment.
Figure 10:
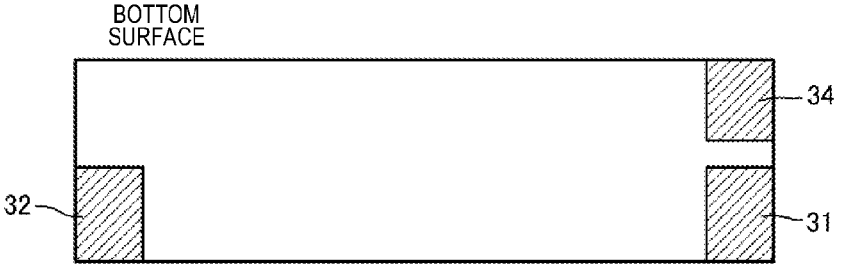

FIG. 10 is the six-surface view of a flexible substrate antenna 105 according to a fifth exemplary embodiment.

A rectangle plate-like flexible substrate 10 according to the fifth exemplary embodiment includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 31 is formed so as to extend from the bottom surface of the flexible substrate 10 to the top surface through the third side surface. In addition, a second parasitic radiation electrode 32 is formed so as to extend from the bottom surface of the flexible substrate 10 to the top surface through the fourth side surface. The leading ends (open ends) of the first parasitic radiation electrode 31 and the second parasitic radiation electrode 32 face each other on the top surface of the flexible substrate 10 with a slit 33 of a predetermined gap therebetween.

On the top surface of the flexible substrate 10, a frequency adjustment electrode 35 is formed. This frequency adjustment electrode 35 faces the first parasitic radiation electrode 31 and the second parasitic radiation electrode 32 within a plain surface. Therefore, a predetermined capacitance occurs between the first and second parasitic radiation electrodes 31, 32 and the frequency adjustment electrode 35.

Ground terminals 36 and 37 are extracted from both end portions of the frequency adjustment electrode 35, the ground terminals 36 and 37 are to be conductively connected to a ground electrode of a mounting destination.

Furthermore, on the top surface of the flexible substrate 10, a capacitive feed electrode 34 is formed at a position facing the first parasitic radiation electrode 31 within a plain surface.

The first parasitic radiation electrode 31 and the second parasitic radiation electrode 32, formed on the bottom surface of the flexible substrate 10, are used as ground terminals for connecting to a ground electrode of a mounting destination.

The equivalent circuit diagram of this flexible substrate antenna 105 is the same as that illustrated in FIG. 8. A function effect is also as described in the third embodiment.

In addition, according to the structure illustrated in FIG. 10, since the capacitive feed electrode 34, the frequency adjustment electrode 35, the first parasitic radiation electrode 31, and the second parasitic radiation electrode 32 are substantially simultaneously patterned, high dimension accuracy is obtained, and it is also possible to suppress a variation in capacitance occurring between the first parasitic radiation electrode 31 and the capacitive feed electrode 34.

Figure 11:
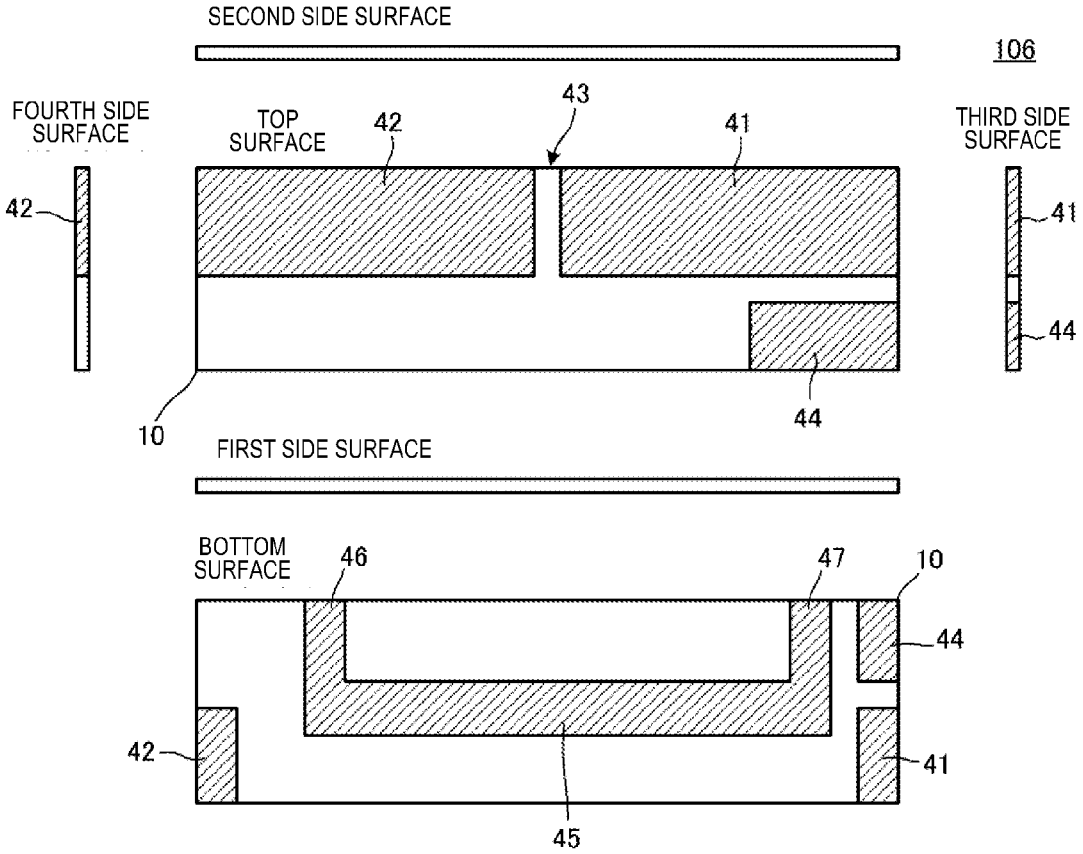
FIG. 11 is a six-surface view of a flexible substrate antenna 106 according to a sixth exemplary embodiment.

FIG. 11 is the six-surface view of a flexible substrate antenna 106 according to a sixth exemplary embodiment.

A rectangle plate-like flexible substrate 10 according to the sixth exemplary embodiment includes a bottom surface (mounting surface having contact with the inner surface of a chassis or the like of a mounting destination), a top surface, a first side surface and a second side surface, which face each other, and a third side surface and a fourth side surface, which face each other.

A first parasitic radiation electrode 41 is formed so as to extend from the bottom surface of the flexible substrate 10 to the top surface through the third side surface. In addition, a second parasitic radiation electrode 42 is formed so as to extend from the bottom surface of the flexible substrate 10 to the top surface through the fourth side surface. The leading ends (open ends) of the first parasitic radiation electrode 41 and the second parasitic radiation electrode 42 face each other on the top surface of the flexible substrate 10 with a slit 43 of a predetermined gap therebetween.

On the bottom surface of the flexible substrate 10, a frequency adjustment electrode 45 is formed. This frequency adjustment electrode 45 faces the first parasitic radiation electrode 41 and the second parasitic radiation electrode 42 with sandwiching the base material of the flexible substrate 10 therebetween. Therefore, a predetermined capacitance occurs between the first and second parasitic radiation electrodes 41, 42 and the frequency adjustment electrode 45.

Ground terminals 46 and 47 are extracted from both end portions of the frequency adjustment electrode 45, the ground terminals 46 and 47 are to be conductively connected to a ground electrode of a mounting destination.

On the top surface of the flexible substrate 10, a capacitive feed electrode 44 is formed at a position facing the first parasitic radiation electrode 41 within a plain surface.

The first parasitic radiation electrode 41 and the second parasitic radiation electrode 42, formed on the bottom surface of the flexible substrate 10, are used as ground terminals for connecting to a ground electrode of a mounting destination.

The equivalent circuit diagram of this flexible substrate antenna 106 is the same as that illustrated in FIG. 8. A function effect is also as described in the third exemplary embodiment.

In addition, while, in the third to sixth exemplary embodiments, a case has been illustrated in which a U-shaped frequency adjustment electrode is formed, the frequency adjustment electrode may also has a rectangular shape. In this regard, however, it is desirable that the ground terminals electrically connected to the ground electrode are provided at two points corresponding to an end portion on a side facing the first parasitic radiation electrode and an end portion on a side facing the second parasitic radiation electrode. This is because the frequency adjustment electrode becomes the above-mentioned current path.

Figure 12:
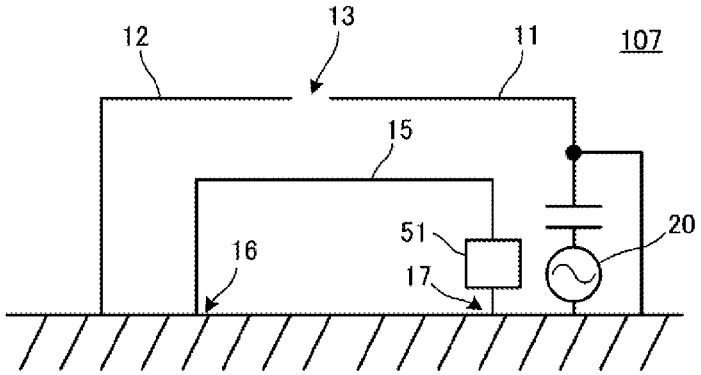
FIG. 12 is an equivalent circuit diagram of a flexible substrate antenna 107 according to a seventh exemplary embodiment.

FIG. 12 is the equivalent circuit diagram of a flexible substrate antenna 107 according to a seventh exemplary embodiment. The circuit of the grounded end of the frequency adjustment electrode 15 is different from the equivalent circuit illustrated in FIG. 8 in the third embodiment. Namely, the first ground terminal 16 of the frequency adjustment electrode 15 is directly grounded, and an impedance element 51 is inserted into the second grounded end 17 of the frequency adjustment electrode 15.

According to such a circuit configuration, since an impedance element is inserted into the path (frequency adjustment electrode 15) of a current flowing owing to the capacitive coupling to the first parasitic radiation electrode 11 and the second parasitic radiation electrode 12, it is also possible to control the resonance frequency of the antenna on the basis of the reactance of the impedance element. For example, if the impedance element 51 is an inductor, the resonance frequency of the antenna is reduced in response to an increase in an inductance component.

In addition, a strong current flows in the parasitic radiation electrode 11 on a power feeding side, compared with the parasitic radiation electrode 12 on a side opposite to the power feeding side. Therefore, a strong current also flows in the frequency adjustment electrode 15 near the grounded end 17 on the power feeding side. Accordingly, by inserting the impedance element 51 into a portion near the power feeding side of the frequency adjustment electrode 15, it is possible to easily adjust a frequency.

Figure 13:
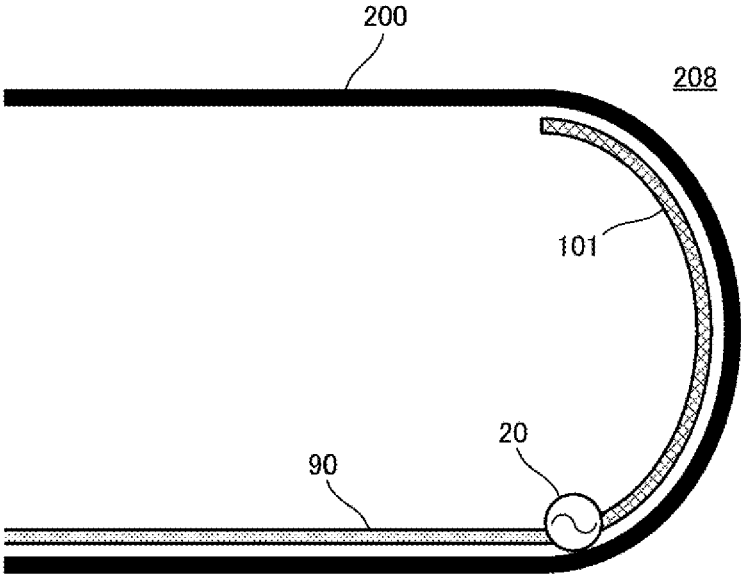
FIG. 13 is a cross-sectional view of an antenna device 208 according to an eighth exemplary embodiment.

FIG. 13 is the cross-sectional view of an antenna device 208 according to an eighth exemplary embodiment. A flexible substrate antenna 101 is attached to the inner surface of the chassis 200 of an electronic device that is an integration destination. In addition, in this example, the flexible substrate antenna 101 is connected to the end portion of a circuit substrate 90. A power feeding circuit 20 is configured on the circuit substrate 90.

The flexible substrate antenna 101 is connected to the end portion of the circuit substrate 90, the circuit substrate 90 is disposed along the plane surface portion of the chassis 200, and the flexible substrate antenna 101 is attached along the curved surface of the chassis 200.

According to such a structure, because it is possible to dispose the flexible substrate antenna 101 so as to distance the flexible substrate antenna 101 from a ground electrode formed in the circuit substrate 90, it is possible to suppress the reduction of an antenna gain.

Figure 14:
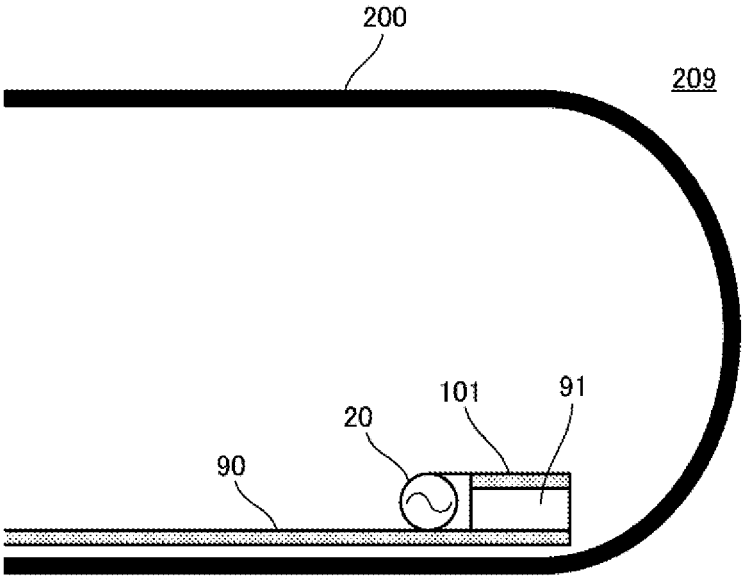
FIG. 14 is a cross-sectional view of an antenna device 209 according to a ninth exemplary embodiment.

FIG. 14 is the cross-sectional view of an antenna device 209 according to a ninth exemplary embodiment. A flexible substrate antenna 101 is attached to a carrier (base) 91 mounted in a circuit substrate. A power feeding circuit 20 is configured on a circuit substrate 90.

According to such a structure, because it is possible to dispose the flexible substrate antenna 101 so as to distance the flexible substrate antenna 101 from a ground electrode formed in the circuit substrate 90, it is possible to suppress the reduction of an antenna gain.

In addition, while, in the examples illustrated in FIG. 13 and FIG. 14, the flexible substrate antenna 101 illustrated in the first exemplary embodiment is provided as the flexible substrate antenna, any one of the flexible substrate antennae 102 to 107 illustrated in the second to seventh embodiments may also be provided.

In embodiments according to the present disclosure, unlike an antenna device of the related art, in which an antenna of the related art utilizing a dielectric block is mounted in a circuit substrate in the state of being adjacent to a ground electrode of the circuit substrate, or an antenna device of the related art, in which an antenna of the related art utilizing a dielectric block is mounted on a ground electrode of a circuit substrate, it is possible to distance the radiation electrode from a ground electrode of the substrate. Therefore, an antenna gain is not deteriorated.

In addition, by causing the first parasitic radiation electrode and the second parasitic radiation electrode to be adjacent to each other, capacitance occurs between the two parasitic radiation electrodes, and it is possible to reduce a resonance frequency. Accordingly, it is possible to downsize the antenna. As a result, it is possible to manufacture an antenna having a lower resonance frequency with the same antenna size, and when the resonance frequency is used as a standard, it is possible to reduce the size of the antenna, and accordingly, it is possible to downsize the antenna.

Because any one of the capacitive feed electrode, the first parasitic radiation electrode, and the second parasitic radiation electrode may be formed on a first surface of the flexible substrate, the capacitive feed electrode, the first parasitic radiation electrode, and the second parasitic radiation electrode can be substantially simultaneously patterned. Hence, it is possible to easily enhance the accuracy of capacitance occurring between these individual electrodes.

In embodiments in which the flexible substrate antenna further includes a frequency adjustment electrode configured to be formed on the flexible substrate, facing the first parasitic radiation electrode and the second parasitic radiation electrode, and configured to be grounded, unlike an antenna device of the related art, in which an antenna of the related art utilizing a dielectric block is mounted in a circuit substrate in the state of being adjacent to a ground electrode of the circuit substrate, or an antenna device of the related art, in which an antenna of the related art utilizing a dielectric block is mounted on a ground electrode of a circuit substrate, it is possible to distance the radiation electrode from a ground electrode of the substrate. Therefore, an antenna gain may not be deteriorated.

In addition, by causing the two parasitic radiation electrodes to be adjacent to each other, capacitance occurs between the two parasitic radiation electrodes, and it is possible to reduce a resonance frequency. In addition, by causing the grounded frequency adjustment electrode to be adjacent to the two parasitic radiation electrodes, capacitance occurs between the frequency adjustment electrode and the two parasitic radiation electrodes, and it is possible to reduce the resonance frequency of the antenna. Accordingly, it is possible to downsize the antenna.

In embodiments in which the frequency adjustment electrode, the first parasitic radiation electrode, and the second parasitic radiation electrode are formed on a first surface of the flexible substrate, since the frequency adjustment electrode, the first parasitic radiation electrode, and the second parasitic radiation electrode are substantially simultaneously patterned, high dimension accuracy is obtained, and it is possible to easily enhance the accuracy of capacitance occurring between the first and second parasitic radiation electrodes and the frequency adjustment electrode. In embodiments in which the frequency adjustment electrode, the first parasitic radiation electrode, the second parasitic radiation electrode, and the capacitive feed electrode are formed in the first surface of the flexible substrate, since the capacitive feed electrode, the frequency adjustment electrode, the first parasitic radiation electrode, and the second parasitic radiation electrode are formed with relatively high dimension accuracy, it is possible suppress a variation in capacitance occurring between the first parasitic radiation electrode and the capacitive feed electrode.

In embodiments in which the capacitive feed electrode, the first parasitic radiation electrode, and the second parasitic radiation electrode are formed in the first surface of the flexible substrate, and the frequency adjustment electrode is formed in a second surface of the flexible substrate, it is possible to enlarge capacitance occurring between the first and second parasitic radiation electrodes and the frequency adjustment electrode, and it is possible to easily enhance a function effect due to the frequency adjustment electrode.

In embodiments in which an antenna device includes any one of the above-mentioned flexible substrate antennae, and a chassis to which the flexible substrate antenna is attached, it is possible to dispose the flexible substrate antenna so that the flexible substrate antenna is distanced from the ground electrode of the circuit substrate, and no unnecessary capacitance occurs between the radiation electrode of the flexible substrate antenna and the ground electrode. Therefore, it is possible to maintain a high antenna gain. In addition, since it is not necessary to mount the antenna on the circuit substrate, it is possible to achieve the downsizing of a whole electronic device including the antenna device.

In embodiments in which an antenna device includes any one of the above-mentioned flexible substrate antennae, and a carrier to which the flexible substrate antenna is attached and that is mounted on a circuit substrate, it is possible to dispose the flexible substrate antenna so that the flexible substrate antenna is distanced from the ground electrode of the circuit substrate, and no unnecessary capacitance occurs between the radiation electrode of the flexible substrate antenna and the ground electrode. Therefore, it is possible to maintain a high antenna gain.

In embodiments according to the present disclosure, a flexible substrate antenna can be attached to the chassis of an electronic device that is an integration destination, or a carrier mounted in a circuit substrate, and hence it is possible to distance the flexible substrate antenna from the ground electrode of the circuit substrate. Therefore, an antenna gain is not deteriorated.

In addition, capacitance occurs between two parasitic radiation electrodes, and it is possible to reduce a frequency. Furthermore, since capacitance occurs between a frequency adjustment electrode and the two parasitic radiation electrodes, it is possible to reduce the resonance frequency of the antenna. Accordingly, it is possible to downsize the antenna.

That which is claimed is:

1. A flexible substrate antenna comprising:

a flexible substrate;

a first parasitic radiation electrode formed so as to extend from a bottom surface of the flexible substrate to a top surface through a first side surface, and a second parasitic radiation electrode formed so as to extend from the bottom surface of the flexible substrate to the top surface through a second side surface, the second side surface facing the first side surface, a capacitive feed electrode on the bottom surface of the flexible substrate, facing the first parasitic radiation electrode, and configured to capacitively feed power to the first parasitic radiation electrode, and wherein an open end of the first parasitic radiation electrode and an open end of the second parasitic radiation electrode face each other on the top surface of the flexible substrate through a slit, and the first parasitic radiation electrode and the second parasitic radiation electrode formed on the bottom surface of the flexible substrate are used as ground terminals, and a capacitance occurs between the first parasitic radiation electrode and the second parasitic radiation electrode.

2. The flexible substrate antenna according to claim 1, further comprising:

a frequency adjustment electrode on the flexible substrate and facing the first parasitic radiation electrode and the second parasitic radiation electrode; and ground terminals extracted from both end portions of the frequency adjustment electrode; wherein the frequency adjustment electrode is along the first parasitic radiation electrode and the second parasitic radiation electrode.

3. The flexible substrate antenna according to claim 2, wherein the frequency adjustment electrode is formed on the bottom surface of the flexible substrate.

4. The flexible substrate antenna according to claim 2, wherein the frequency adjustment electrode is formed on the top surface of the flexible substrate, and faces the first parasitic radiation electrode and the second parasitic radiation electrode within a plane surface.

5. The flexible substrate antenna according to claim 3, further comprising:

an impedance element inserted into the frequency adjustment electrode.

6. An antenna device comprising:

a flexible substrate antenna according to claim 1; and a chassis to which the flexible substrate antenna is attached.

7. An antenna device comprising:

a flexible substrate antenna according to claim 1; and a carrier to which the flexible substrate antenna is attached and that is mounted on a circuit substrate.

* * * * *